US005361425A

United States Patent [19]

Armanno, Sr.

[11] Patent Number: 5,361,425

[45] Date of Patent: Nov. 8, 1994

[54] LATERAL RETAINERS FOR TOILET SEAT

[76] Inventor: Frank Armanno, Sr., 14399 Picea Ct., Ft. Pierce, Fla. 34951

[21] Appl. No.: 165,593

[22] Filed: Dec. 13, 1993

[51] Int. Cl.[5] ..... A47K 13/04

[52] U.S. Cl. ..... 4/248; 16/86 A

[58] Field of Search ..... 4/248, 234–239; 267/139, 140, 140.11; 16/86 A, 86 B, 86 R, DIG. 20, 42 R, 42 T

[56] References Cited

U.S. PATENT DOCUMENTS

| | | | |
|---|---|---|---|
| 970,425 | 9/1910 | Curran | 16/42 R |
| 972,820 | 10/1910 | Cleis | 4/248 |
| 1,190,310 | 7/1916 | Long | 16/86 A |
| 1,626,955 | 5/1927 | Newton | 16/86 A |
| 1,682,798 | 9/1928 | Richards | 4/248 |
| 2,104,714 | 1/1938 | Moore | 4/240 |
| 2,109,829 | 3/1938 | Roe | 4/248 |
| 2,873,454 | 2/1959 | Phillips | 4/248 |
| 2,968,116 | 1/1961 | Arenson | 16/42 R |
| 3,646,620 | 3/1972 | McCawley | 4/237 |
| 4,747,167 | 5/1988 | Adams | 4/234 |
| 4,806,437 | 2/1989 | Yokoi et al. | 267/140.11 |
| 4,893,360 | 1/1990 | Wofford | 4/237 |
| 5,212,840 | 5/1993 | Caldwell | 4/237 |

FOREIGN PATENT DOCUMENTS

| | | | |
|---|---|---|---|
| 619022 | 8/1980 | Switzerland | 16/86 R |

*Primary Examiner*—Henry J. Recla
*Assistant Examiner*—Gregory M. Vidovich
*Attorney, Agent, or Firm*—Richard C. Litman

[57] ABSTRACT

A retainer provides for the prevention of lateral slippage or movement of a toilet seat or a toilet bowl rim. Typically, bowl rims are not uniformly level or even, and conventional bumpers, along with the play generally found in the seat hinges, allow a seat to slip laterally relative to the rim, and occasionally drop slightly as the bumper(s) is/are displaced to one edge of the bowl rim as the seat shifts. The present retainers each include inner and outer depending retainer portions, which serve to prevent lateral displacement of the seat in either direction relative to the rim. Thus, only a single retainer is required, although preferably two are installed on opposite sides of the seat bottom and toward the front of the seat for uniformity. The present retainers include a resilient intermediate portion, which allows the depending retainer portions and member from which they depend, to arcuately rock to accommodate uneven bowl rims. The device(s) may be mechanically or adhesively secured to the seat bottom.

13 Claims, 2 Drawing Sheets

LATERAL RETAINERS FOR TOILET SEAT

FIELD OF THE INVENTION

The present invention relates generally to brackets, keepers, retainers, and the like, and more specifically to retaining brackets installable on the bottom surface of a hinged toilet seat, and providing for the lateral retaining of the seat on the underlying toilet bowl rim when in the seat is in a lowered position. The retainers provide some arcuate resilience in order to conform to any misalignment between the toilet bowl rim and the bottom surface of the seat.

BACKGROUND OF THE INVENTION

The adaptation of wood or plastic toilet seats having plastic or metal hinges and fittings to a porcelain toilet bowl, invariably leads to some play in the attachment between the seat hinge brackets and the bowl. Due to manufacturing tolerances and flow during baking, the porcelain bowls will always vary somewhat from one another, and allowance is made for this fact by providing relatively large holes for the seat and cover hinge mounting brackets. Such variation between individual units can also be seen in the differing shapes and slopes of the bowl rims of finished toilets.

Further, typically the brackets, fittings and fasteners are formed of some type of plastic, which precludes sufficient tightening of the fasteners to positively secure the fittings to the bowl without possibility of slippage. Attempting such tightening leads to the stripping of the threads or other damage to the relatively soft plastic fittings.

The result of the above relatively loose tolerances and soft fasteners is that frequently a toilet seat and accompanying lid or cover will be relatively loosely attached to the back of the bowl, with the attachment allowing a relatively larger amount of lateral arcuate play near the front of the seat and lid relative to the bowl. The standard plastic or rubber bumpers installed upon the bottom of a toilet seat serve to prevent the marring of the underlying bowl rim, but do little or nothing to prevent the lateral slippage of the seat relative to the rim. In fact, the relatively small bumpers may even encourage such slippage or play, due to their relative height in combination with the possibly sloped and/or curved low friction surface of the bowl rim.

The seat and lid may tend to align properly with the bowl rim when no pressure is placed upon them, but often such appearance of alignment is illusory, is when a person places his or her weight upon the seat or lid, the seat bumpers will shift laterally on the bowl rim and the seat will also shift an inch or so and drop down to rest directly upon the bowl rim. This action is disconcerting to say the least, even when one knows the characteristics of a specific toilet and is aware of the above possibility. While the result may be humorous to some persons, the elderly or infirm using such a toilet may be startled to the point of losing their balance and slipping from the seat, thus possibly risking serious injury.

The need arises for retainers installable to the bottom surface of a toilet seat, and providing for the lateral security of the seat relative to the bowl rim. The retainers must be formed to positively grip the inner and outer edges of the rim, and further must provide some angular resilience in order to accommodate bowl rims having different slopes.

DESCRIPTION OF THE PRIOR ART

U.S. Pat. No. 2,104,714 issued to Francis J. Moore on Jan. 4, 1938 discloses a Toilet Seat having two laterally spaced apart halves, with adjustable spacing therebetween. The bumpers beneath the seat halves are also adjustable and each include a single depending extension to catch the outer edge of the rim, but the bumpers must be manually adjusted with a tool (e.g., screwdriver) each time the spacing between the seat halves is adjusted. The present retainer provides a depending element to each side of the rim edge, and no adjustment whatsoever is required.

U.S. Pat. No. 3,646,620 issued to Joseph F. McCawley on Mar. 7, 1972 discloses a Toilet Seat Guide, two of which are immovably affixed to opposite sides of the seat bottom. Each of the guides includes only a single depending retainer, thus requiring two of the guides. No provision is made to accommodate uneven bowl rims or to replace the standard bumpers, as in the case of the present invention.

U.S. Pat. No. 4,747,167 issued to Harold D. Adams on May 31, 1988 discloses a Non-Shiftable Toilet Seat Assembly. The majority of the disclosure is directed to a multiple seat assembly for use by adults and children, but also discloses various embodiments of bumpers installable to the first seat bottom. While in at least one embodiment the bumpers have two opposite depending retaining portions, the bumpers are immovably affixed to the seat bottom and cannot accommodate any nonparallel condition between the bowl rim and seat bottom, as can the present invention.

U.S. Pat. No. 4,893,360 issued to Barry Wofford on Jan. 16, 1990 discloses an Apparatus For Positioning A Seat On The Rim Of A Toilet Bowl. The assembly requires at least two mating retainers to be immovably affixed to both the bowl rim and seat bottom, whereas the present invention requires only a single retainer on the seat bottom; the rim need not be modified. In addition, the Wofford device would be relatively difficult to clean, due to the concave internal shape of one of the components.

Finally, U.S. Pat. No. 5,212,840 issued to Leroy Caldwell on May 25, 1993 discloses a Stabilizing Toilet Seat Guide. The device is similar to the McCawley device discussed above, but includes specific angles and dimensions for the depending retaining portion. However, no accommodation for differences between seat and bowl rim is provided, as in the present invention.

None of the above noted patents, taken either singly or in combination, are seen to disclose the specific arrangement of concepts disclosed by the present invention.

SUMMARY OF THE INVENTION

By the present invention, an improved retainer for the prevention of lateral slippage of a toilet seat, is disclosed.

Accordingly, one of the objects of the present invention is to provide an improved retainer which automatically provides accommodation for angular differences between the seat bottom to which the retainer is installed, and the underlying bowl rim.

Another of the objects of the present invention is to provide an improved retainer which includes a resilient intermediate member between the seat bottom to which it is attached, and the retainer portion which mates with the bowl rim.

Yet another of the objects of the present invention is to provide an improved retainer which is adaptable to a wide variety of bowl rim widths, shapes and angles.

Still another of the objects of the present invention is to provide an improved retainer which serves to replace any bumpers or other spacers affixed to the bottom of a seat, rather than requiring their use in addition to the present invention.

A further object of the present invention is to provide an improved retainer which may be secured to the seat bottom either mechanically or adhesively.

An additional object of the present invention is to provide an improved retainer which provides for ease of cleaning.

A final object of the present invention is to provide an improved retainer for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
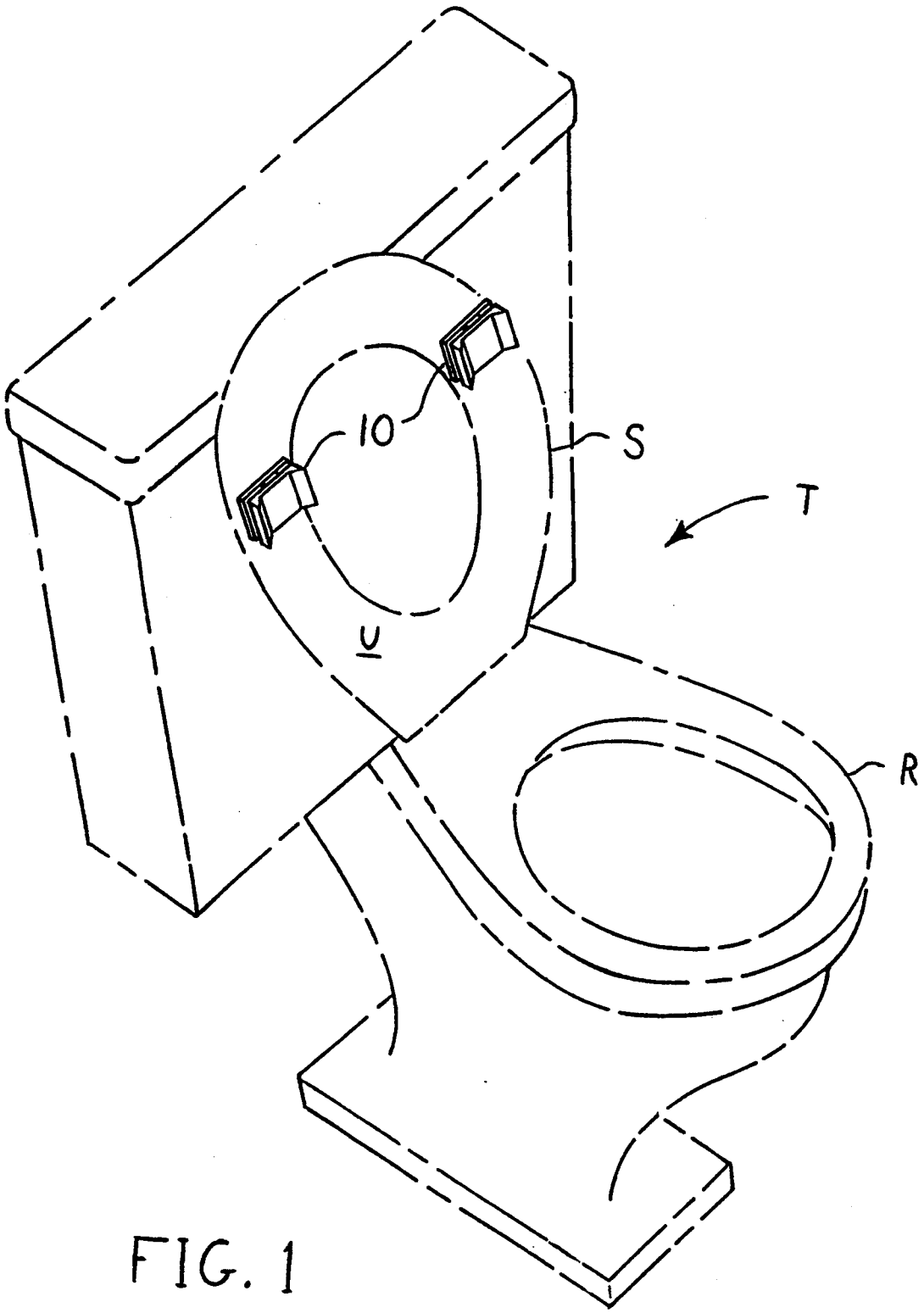
FIG. 1 is a perspective view of a toilet including a seat in the raised position, showing two retainers of the present invention installed on the bottom surface of the seat.

Referring now particularly to FIG. 1 of the drawings, the present invention will be seen to relate to a retainer 10 serving to preclude the lateral slippage of a toilet seat S relative to the bowl rim R of a toilet T. FIG. 1 shows a pair of retainers 10 installed on the bottom surface or underside U of a toilet seat 10, in a position to engage the upper edge of the rim R of the toilet bowl when the seat is lowered to a horizontal position.

Figure 2:
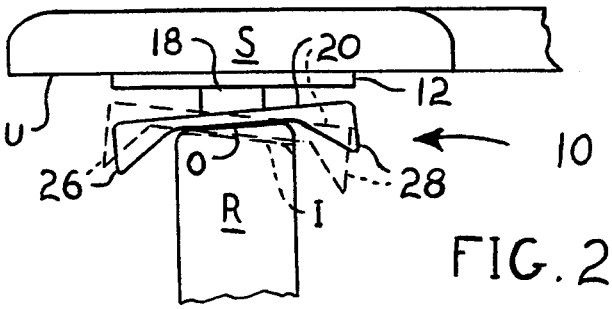
FIG. 2 is a side view in section of a toilet bowl rim and seat, showing the ability of the retainer to conform to varying rim configurations.

FIG. 2 provides a detailed view of a single retainer 10 of the present invention, secured to the underside U of a seat S and positioned between the seat 2S and bowl rim R with the seat S in a lowered position. Retainer 10 comprises a flat, planar retainer base portion 12, which provides a base for installation to a toilet seat S. The planar base portion 12 includes a seat bottom contact surface 14 (FIG. 3), and an opposite surface 16 (FIG. 4) having a central resilient member 18 extending therefrom. A bowl rim engaging portion 20 is spaced apart from the base portion 12, and connected thereto by means of the central resilient member 18. Thus, the central resilient member 18 is sandwiched between the base portion 12 and the rim engaging portion 20.

The rim engaging portion 20 will be seen to be specially shaped and formed to accomplish the desired function of positively grasping the bowl rim R to preclude relative lateral movement of the seat S. The central area of the rim engaging portion 20 is generally flat and planar, in the manner of the base portion 12, but includes opposite first and second ends 22 and 24 (FIGS. 3 and 4) respectively disposed outwardly and inwardly relative to the seat S (and therefore the rim R) when the retainer is installed thereon. Each of the ends respectively has a first and second depending rim retaining portion 26 and 28 extending therefrom, which rim retaining portions 26 and 28 serve to capture the rim R therebetween when the seat S is lowered.

The rim retaining portions 26 and 28 are tapered, thus providing a relatively wide tolerance when the seat S is lowered in proximity to the rim R, and providing for any differences in alignment between rim R and the retainer(s) 10 to be taken up. As the seat S is fully lowered so that rim engaging portion 20 is in contact with the rim R, the relatively narrower width between the two rim retaining portion 26 and 28 immediately adjacent the bowl rim engaging surface 30 (FIG. 4) of the rim engagement portion 20, will more securely capture the rim R therebetween to preclude lateral slippage or movement of the retainer(s) 10, and thus the seat S to which they are secured, relative to the bowl rim R.

Figure 3:
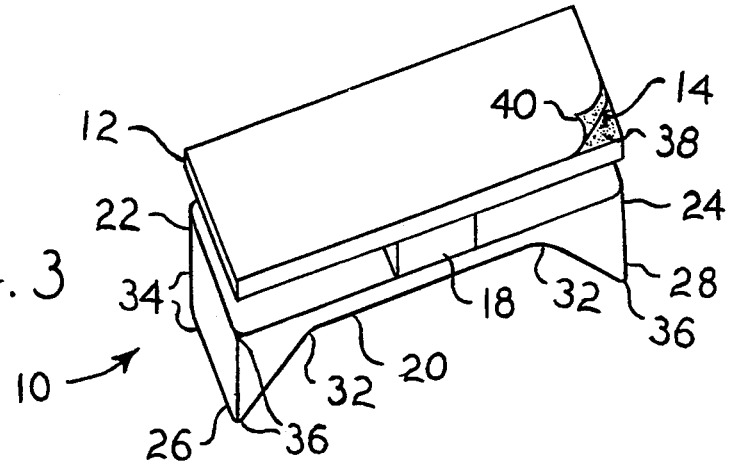
FIG. 3 is a perspective view of the retainer base, showing the adhesive attachment means and release sheet therefor.
Figure 4:
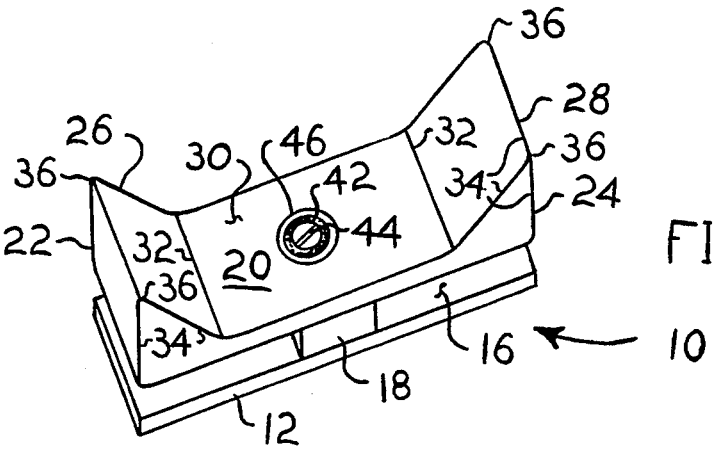
FIG. 4 is a perspective view showing the bowl rim engaging portion and alternative attachment means comprising a screw or fastener having a recessed head.

The concave edges 32, convex edges 34, and convex corners 36 of the rim engaging portion 20 and rim retaining portions 26 and 28 are rounded, as shown in FIGS. 3 and 4, to eliminate sharp edges and corners which could snag a cleaning cloth or the like and to provide for easier cleaning of the retainer 10. The corners of the retainer base portion 12 may be rounded in like manner, if desired.

FIG. 3 discloses a first means of securing the present retainer 10 to the underside U of a toilet seat S, comprising an adhesive layer or coating 38 on the seat bottom contact surface 14 of the retainer base portion 12. The adhesive layer 38 is protected by a release sheet until the retainer 10 is ready for installation. At that point, the release sheet 40 is removed and the retainer 10 is adhesively secured to the bottom side U of the seat S, in a position for the depending rim retaining portions 26 and 28 to rest to either side of the rim R when the seat S is lowered.

FIG. 4 discloses a second means of securing the retainer 10 to a seat bottom U. In the retainer 10 of FIG. 4, a mechanical fastener 42 (e.g., screw) is passed centrally through the bowl rim engaging portion 20, the central resilient member 18, and the retainer base portion 12. The fastener 42 secures to the underside U of the seat S to hold the retainer 10 in place thereon. It will be seen that the head 44 of the fastener 42 might protrude from the surface 30 of the bowl rim engaging portion 20, and thereby cause the rim R to be marred or damaged when the seat S is lowered thereon. Accordingly, a recess 46 (e.g., counterbore or countersink) is provided below the rim engaging portion surface 30, in order to allow the fastener head 44 to be recessed below the rim engaging portion surface 30 and to preclude marring of the surface of the rim R.

The present retainer(s) may be installed upon a seat bottom U using either of the means described above, and positioned so the two depending rim retaining portions 26 and 28 fit to either side of the toilet bowl rim R when the seat S is lowered, as discussed above and shown in the various drawing figures.

A problem which commonly occurs with ceramic toilet fixtures, is that due to casting, molding and/or curing techniques, there will almost always be at least slight differences between individual units. An examination of such fixtures will almost always reveal some slight unevenness and/or non-uniformity in the finished, glazed surface of the fixtures. For this reason, the holes or passages formed adjacent to the back of the bowl rim are generally at least slightly oversize, in order to compensate for the relatively wide tolerances required to allow for inconsistencies between individual units. This usually results in the hinge or other attachment means having a relatively large amount of play, which play is amplified near the front portion of the seat due to the arcuate shifting of a seat at the attachment point(s). The present invention will be seen to secure the forward portion of the seat against such lateral movement or shifting, thus providing greater security for a user of the toilet, particularly the elderly and/or infirm.

The manufacturing variations discussed above will also commonly result in the toilet bowl rim R having some inward or outward slope from the horizontal. The resilient central member 18 compensates for such an inward slope I (shown in broken lines) or outward slope O, as shown in FIG. 2, by automatically compressing toward the higher side of the rim and allowing the attached bowl rim engaging portion 20 to shift arcuately to accommodate the non-level bowl rim R. This accommodation for less than perfect bowl rims R, along with the inward and outward depending rim retaining portions 26 and 28, will be seen to provide for the securing of the forward portion of a toilet seat S relative to the underlying rim R under virtually any conditions likely to occur.

In accordance with the above, the present invention will be seen to provide for the security of even a relatively loosely fitting toilet seat S on an uneven underlying rim R, under virtually any out of tolerance conditions likely to occur. The retainer 10 of the present invention may be formed of a variety of materials. The retainer base portion 12 and the bowl rim engaging portion 20 and accompanying depending rim retaining portions 26 and 28 are preferably formed of a relatively tough and durable plastic material (e.g., Nylon, tm), while the resilient central member is preferably formed of an elastomer material of some sort in order to provide the required compliance with an uneven rim R. Other materials may be substituted for the above, as may be suitable or desirable.

It is to be understood that the present invention is not limited to the sole embodiment described above, but encompasses any and all embodiments within the scope of the following claims.

I claim:

1. A retainer for the prevention of lateral slippage between a toilet seat and an underlying toilet bowl rim, said retainer comprising:

a planar retainer base portion having a first thickness, a base mounting region and a seat bottom contact surface, and means for securing said contact surface against the bottom surface of a toilet seat;

a bowl rim engaging portion including a central engaging region, a first end and an oppositely disposed second end, said first end of said bowl rim engaging portion including a first retaining portion, and said second end of said bowl rim engaging portion including a second retaining portion; and a resilient member having a second thickness with a first end connected to and extending from said base mounting region and a second end connected to said central engaging region, wherein said resilient member is sandwiched between said retainer base portion and said bowl rim engaging portion thereby defining a spaced relationship between said retainer base portion and said bowl rim engaging portion.

2. The retainer of claim 1 wherein:

said means for securing said retainer to the bottom surface of the toilet seat comprises said seat bottom contact surface being coated with an adhesive material, with said adhesive material having a removable release sheet disposed thereover, whereby;

said release sheet is removed from said seat bottom contact surface thereby to expose said adhesive disposed thereon, and said retainer is affixed to the toilet seat bottom surface by means of said adhesive material.

3. The retainer of claim 1 wherein:

said means providing for the securing of said retainer to the bottom surface of the toilet seat comprises said retainer having a mechanical fastener passing therethrough, whereby;

said mechanical fastener is used to secure said retainer to the toilet seat bottom surface.

4. The retainer of claim 3 wherein:

said bowl rim engaging portion includes a bowl rim engaging surface, and said mechanical fastener includes a recessed head portion disposed below said bowl rim engaging surface, whereby;

said recessed head is precluded from marring the toilet bowl rim.

5. The retainer of claim 3 wherein:

said mechanical fastener is a screw.

6. The retainer of claim 4 wherein:

said mechanical fastener is a screw.

7. The retainer of claim 1 wherein:

said bowl rim engaging portion includes a plurality of concave and convex edges and corners, with each of said concave and convex edges and corners being rounded.

8. The retainer of claim 1 wherein:

at least said retainer base portion and said bowl rim engaging portion are formed of plastic.

9. The retainer of claim 1 wherein:

at least said resilient member is formed of an elastomer material.

10. The retainer of claim 1 wherein said first retaining portion includes a first beveled edge extending away from said first end of said bowl engaging portion, and said second retaining portion includes a second beveled edge extending away from said second end of said bowl engaging portion.

11. The retainer of claim 1 wherein said toilet bowl rim includes an inner and outer surface;

wherein said first retaining portion is configured to cooperate with the inner surface of the toilet bowl rim, and said second retaining portion is configured to cooperate with the outer surface of the toilet bowl rim.

12. The retainer of claim 1 wherein said bowl engaging portion is substantially rigid.

13. The retainer of claim 1 wherein said retainer is adapted to be secured to the bottom surface of the toilet seat with said first and said second retaining portion of said retainer adapted to be disposed to either side of the toilet bowl rim when the toilet seat is lowered to preclude lateral slippage of the toilet seat relative to the toilet bowl rim, and said resilient member allows said bowl rim engaging portion to be angularly displaced in order to accommodate the toilet bowl rim.

* * * * *